US008655241B2

(12) United States Patent
Zaretsky et al.

(10) Patent No.: US 8,655,241 B2
(45) **Date of Patent: *Feb. 18, 2014**

(54) ELECTROPHOTOGRAPHIC PRINTER WITH COMPRESSIBLE-BACKUP TRANSFER STATION

(75) Inventors: Mark Cameron Zaretsky, Rochester, NY (US); Andrew Peter Kittleson, Rochester, NY (US); James H. Huntington, Penfield, NY (US); Timothy John Young, Williamson, NY (US); Jerry Eugene Livadas, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 260 days.

This patent is subject to a terminal disclaimer.

(21) Appl. No.: 13/220,776

(22) Filed: Aug. 30, 2011

(65) Prior Publication Data

US 2013/0051873 A1 Feb. 28, 2013

(51) Int. Cl.
*G03G 15/16* (2006.01)

(52) U.S. Cl.
CPC ..... *G03G 15/167* (2013.01)
USPC ..... 399/318

(58) Field of Classification Search
USPC ..... 399/318
See application file for complete search history.

(56) References Cited

U.S. PATENT DOCUMENTS

| | | | | |
|---|---|---|---|---|
| 5,040,026 | A | 8/1991 | Jamzadeh | |
| 5,897,247 | A | 4/1999 | Tombs et al. | |
| 5,897,248 | A * | 4/1999 | Schlueter et al. | 399/313 |
| 6,608,641 | B1 | 8/2003 | Alexandrovich et al. | |
| 7,120,379 | B2 | 10/2006 | Eck | |
| 7,878,504 | B2 * | 2/2011 | Ikeda et al. | 271/274 |
| 2002/0114642 | A1 | 8/2002 | Rimai et al. | |
| 2002/0168200 | A1 | 11/2002 | Stelter et al. | |
| 2006/0133870 | A1 | 6/2006 | Ng | |
| 2009/0054576 | A1 * | 2/2009 | Park et al. | 524/405 |
| 2011/0150517 | A1 * | 6/2011 | Chauvin et al. | 399/66 |
| 2013/0022379 | A1 * | 1/2013 | Young et al. | 399/312 |

* cited by examiner

*Primary Examiner* — Walter L Lindsay, Jr.
*Assistant Examiner* — Philip Marcus T Fadul
(74) *Attorney, Agent, or Firm* — Christopher J. White; Raymond L. Owens

(57) ABSTRACT

An electrophotographic (EP) printer for transferring a toner image to a receiver sheet has a tensioned rotatable transport web with a Young's modulus of at least 1 GPa. The transport web is wrapped around a compliant image-bearing member. A compressible, rotatable nip-forming member that is relatively less stiff than the image-bearing member is adjacent to the transport web on the opposite side thereof from the image-bearing member. A mount holds the nip-forming member against the image-bearing member, and permits the axis of rotation of the nip-forming member to move closer to or farther from the transport web. When the leading edge of the receiver on the web engages with the image-bearing member, the nip-forming member compresses. The axis of rotation of the nip-forming member translates by an amount less than the thickness of the receiver sheet minus the compression of the compliant coating of the image-bearing member.

4 Claims, 6 Drawing Sheets

ELECTROPHOTOGRAPHIC PRINTER WITH COMPRESSIBLE-BACKUP TRANSFER STATION

CROSS-REFERENCE TO RELATED APPLICATIONS

Reference is made to commonly assigned, co-pending U.S. patent application Ser. No. 13/220,795 filed Aug. 30, 2011, entitled "Printer with Compressible and Incompressible Transfer Backups," by Mark C. Zaretsky, et al., the disclosure of which is incorporated by reference herein.

FIELD OF THE INVENTION

This invention pertains to the field of printing and more particularly to improving image quality of various types of printed images.

BACKGROUND OF THE INVENTION

Printers are useful for producing printed images of a wide range of types. Printers print on receivers (or "imaging substrates"), such as pieces or sheets of paper or other planar media, glass, fabric, metal, or other objects. Printers typically operate using subtractive color: a substantially reflective receiver is overcoated image-wise with separations of cyan (C), magenta (M), yellow (Y), black (K), light black (Lk), and other colorants, one at a time.

In various printers, receiver sheets are transported by a transport web or belt through a plurality of printing modules. Each printing module deposits a single separation on the receiver sheet. In such printers, a plurality of receiver sheets can be present on the transport web simultaneously. In one example, a five-station printer can transport five sheets on the web simultaneously, with one sheet being printed in each module at any given time. More or fewer sheets can be accommodated on the web simultaneously depending on the spacing between printing modules and the length of each receiver sheet. Moreover, a single receiver sheet can be engaged in two or more modules simultaneously if the receiver length is greater than the spacing between modules.

SUMMARY OF THE INVENTION

However, when multiple print modules are printing on one or more receiver sheets simultaneously, mechanical disturbances from one printing module can produce image artifacts in other modules. FIGS. 3A-3D show an example of this problem as it occurs in one printing module. These figures show the entrance of receiver sheet 42 on transport web 81 into transfer nip 310 as described in prior systems. Transfer nip 310 is formed between an image-bearing member 320 (which can be intermediate transfer component 112 or imaging component 111, FIG. 2) and a nip-forming member 330 (which can be transfer backup component 113, FIG. 2).

FIG. 3A shows these components before receiver sheet 42 reaches transfer nip 310. Transfer nip 310 includes all or part of the extent of transport web 81 in contact with both image-bearing member 320 and nip-forming member 330 (which are on opposite sides of transport web 81). Transfer region 315 includes all or part of the portion of transport web 81 in contact with image-bearing member 320. In transfer region 315, toner is transferred to receiver sheet 42.

FIG. 3B shows receiver sheet 42 beginning to engage image-bearing member 320. FIG. 3C shows receiver sheet 42 having engaged image-bearing member 320, and about to enter transfer nip 310. It has been determined that, as shown, transport web 81 has a bend or kink (hereinafter referred to as a "kink") at point 381 because of the thickness 342 of receiver sheet 42.

FIG. 3D shows receiver sheet 42 having entered transfer nip 310. Nip-forming member 330 has been displaced by displacement 311 to permit receiver sheet 42 with thickness 342 to enter transfer nip 310.

It has been determined that the kink at point 381 (FIG. 3C) and the displacement of nip-forming member 330 (FIG. 3D) produce mechanical waves (shock waves) that propagate along transport web 81. These shock waves can cause visible image artifacts on prints in other nips. For example, referring to FIG. 1, shock waves caused when receiver sheet 42 enters the transfer nip of printing module 32 can cause image artifacts on receiver sheets 42 in printing modules 31 or 33 when the shock waves reach the transfer nips thereof.

Various schemes have been proposed to solve this problem. For example, the nip can be actively opened before the sheet reaches it and then closed to engage the sheet. However, this scheme increases the difficulty of producing borderless prints, since the top of the sheet is not firmly engaged in the nip as the nip closes. Moreover, this scheme cannot be used in friction-drive systems in which the transport web provides the motive power for the other rotating components of the printer. There is a continuing need, therefore, for a way of reducing the power of shock waves that can cause image artifacts.

According to an aspect of the present invention, there is provided an electrophotographic (EP) printer adapted to transfer a toner image to a receiver sheet carried on a rotatable transport web, the printer comprising:

a) the rotatable transport web having a Young's modulus of at least 1 GPa and maintained under tension; and b) a transfer station including:

i) a rotatable image-bearing member around which the transport web is at least partially wrapped so that a transfer region is defined in which toner is transferred from the image-bearing member to the receiver sheet, the image-bearing member having a compliant coating;

ii) a compressible, rotatable nip-forming member adjacent to the transport web on the opposite side thereof from the image-bearing member, the nip-forming member being relatively less stiff than the image-bearing member; and iii) a mount arranged to cause the nip-forming member to press the transport web towards the image-bearing member, and adapted to permit the axis of rotation of the nip-forming member to move closer to or farther from the transport web;

c) so that when the leading edge of the moving receiver sheet on the transport web engages with the image-bearing member, the nip-forming member compresses so that while the leading edge of the receiver sheet passes through the transfer region, the axis of rotation of the nip-forming member translates by an amount less than the thickness of the receiver sheet minus the compression of the compliant coating of the image-bearing member.

An advantage of this invention is that it reduces the magnitude of shock waves created when the lead edge or trail edge of a receiver enters or exits the transfer nip, thereby reducing the occurrence or severity of image artifacts. Another advantage is that it can dampen shock waves created when the lead edge or trail edge of a receiver enters or exits a transfer nip upstream or downstream of a selected transfer nip, thereby reducing image artifacts in the selected transfer nip. Yet another advantage is that it reduces the sensitivity of the printer image quality to receiver thickness, image-bearing member compliance, transport web tension, and transfer nip load pressure. Various embodiments reduce artifacts due to shock waves in non-friction-driven systems or in friction-driven systems. Various embodiments reduce artifacts even when the nip-forming member is opposite the receiver with respect to a transport web including a very stiff layer.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

Figure 1:
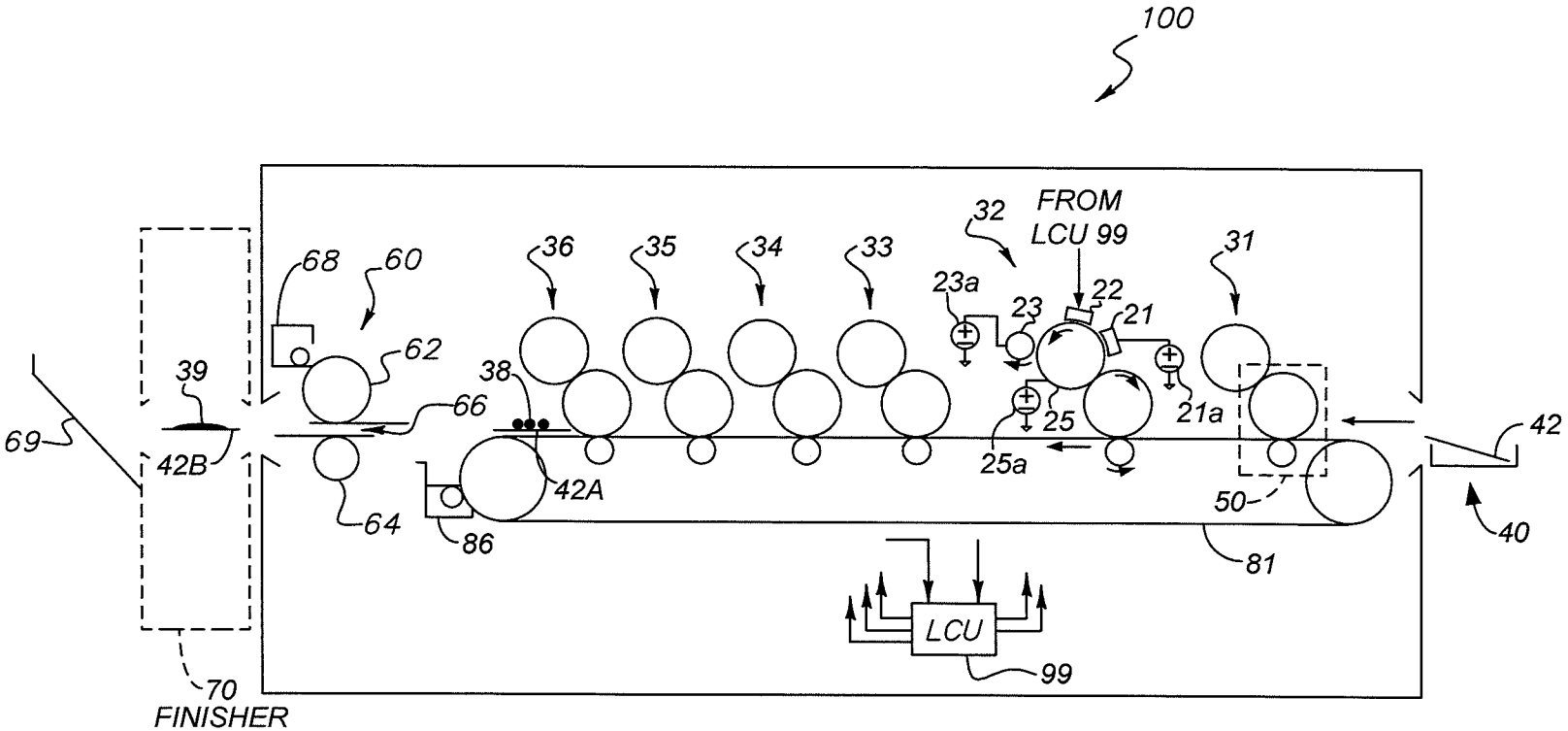
FIG. 1 is an elevational cross-section of an electrophotographic reproduction apparatus.

The attached drawings are for purposes of illustration and are not necessarily to scale.

DETAILED DESCRIPTION OF THE INVENTION

The electrophotographic (EP) printing process can be embodied in devices including printers, copiers, scanners, and facsimiles, and analog or digital devices, all of which are referred to herein as "printers." Various embodiments use electrostatographic printers such as electrophotographic printers that employ toner developed on an electrophotographic receiver, or ionographic printers and copiers that do not rely upon an electrophotographic receiver. Electrophotography and ionography are types of electrostatography (printing using electrostatic fields), which is a subset of electrography (printing using electric fields).

A digital reproduction printing system ("printer") typically includes a digital front-end processor (DFE), a print engine (also referred to in the art as a "marking engine") for applying toner to the receiver, and one or more post-printing finishing system(s) (e.g. a UV coating system, a glosser system, a laminator system, a sorting system, a binding system, a stapling system, or a folding system). A printer can reproduce black-and-white or color images onto a receiver. A printer can also produce selected patterns of toner on a receiver, which patterns (e.g. surface textures) do not correspond directly to a visible image. The DFE receives input electronic files (such as Postscript command files) composed of images from other input devices (e.g., a scanner, a digital camera). The DFE can include various function processors, e.g. a raster image processor (RIP), image positioning processor, image manipulation processor, color processor, or image storage processor. The DFE rasterizes input electronic files into image bitmaps for the print engine to print. In some embodiments, the DFE permits a human operator to set up parameters such as layout, font, color, media type, or post-finishing options. The print engine takes the rasterized image bitmap from the DFE and renders the bitmap into a form that can control the printing process from the exposure device to transferring the print image onto the receiver. The finishing system applies features such as protection, glossing, or binding to the prints. The finishing system can be implemented as an integral component of a printer, or as a separate machine through which prints are fed after they are printed.

The printer can also include a color management system which captures the characteristics of the image printing process implemented in the print engine (e.g. the electrophotographic process) to provide known, consistent color reproduction characteristics. The color management system can also provide known color reproduction for different inputs (e.g. digital camera images or film images).

In an embodiment of an electrophotographic modular printing machine, e.g. the NEXPRESS 3000SE printer manufactured by Eastman Kodak Company of Rochester, N.Y., color-toner print images are made in a plurality of color imaging modules arranged in tandem, and the print images are successively electrostatically transferred to a receiver sheet adhered to a transport web moving through the modules. Colored toners include colorants, e.g. dyes or pigments, which absorb specific wavelengths of visible light. The NEXPRESS employs intermediate transfer members in the respective modules for transferring visible images from the photoreceptor and transferring successive print images in register to the receiver sheet to form a multicomponent print image.

In other electrophotographic printers, each visible image is directly transferred from photoreceptor 25 to a receiver sheet 42 to form the corresponding print image. In still other printers, color separations are accumulated on an intermediate transfer belt and transferred together onto the receiver 42. A compressible backup member is used to engage the intermediate belt against the toned photoreceptor 25. When transferring the color image from the intermediate belt to the receiver 42, a compressible backup roller behind the receiver is used to sandwich the receiver 42 to the belt, with a roller behind the belt. XEROX IGEN printers accumulate the color separations on the photoreceptor and transfer the color image together onto the receiver. HP INDIGO printers accumulate color separations on an intermediate blanket gripped onto a cylinder and transfer the color image together onto the receiver 42.

Electrophotographic printers having the capability to also deposit clear toner using an additional imaging module are also known. As used herein, clear toner is considered to be a color of toner, as are C, M, Y, K, and Lk, but the term "colored toner" excludes clear toners. The provision of a clear-toner overcoat to a color print is desirable for providing protection of the print from fingerprints and reducing certain visual artifacts. Clear toner uses particles that are similar to the toner particles of the color development stations but without colored material (e.g. dye or pigment) incorporated into the toner particles. However, a clear-toner overcoat can add cost and reduce color gamut of the print; thus, it is desirable to provide for operator/user selection to determine whether or not a clear-toner overcoat will be applied to the entire print. A uniform layer of clear toner can be provided. A layer that varies inversely according to heights of the toner stacks can also be used to establish level toner stack heights. The respective toners are deposited one upon the other at respective locations on the receiver sheet and the height of a respective toner stack is the sum of the toner heights of each respective color. Uniform stack height provides the print with a more even or uniform gloss.

FIG. 1 is an elevational cross-section showing portions of a typical electrophotographic printer 100. Printer 100 is adapted to produce print images, such as single-color (monochrome), CMYK, or hexachrome (six-color) images, on a receiver sheet 42 (multicolor images are also known as "multi-component" images). Images can include text, graphics, photos, and other types of visual content. Various embodiments involve printing using an electrophotographic print engine having six sets of single-color image-producing or -printing stations or modules arranged in tandem, but more or fewer than six colors can be combined to form a print image on a given receiver sheet. Other electrophotographic writers or printer apparatus can also be included. Various components of printer 100 are shown as rollers; other configurations are also possible, including webs.

Referring to FIG. 1, printer 100 is an electrophotographic printing apparatus having a number of tandemly-arranged electrophotographic image-bearing printing modules 31, 32, 33, 34, 35, 36, also known as electrophotographic imaging subsystems. Each printing module produces a single-color toner image for transfer using a respective transfer subsystem 50 (for clarity, only one is labeled) to a receiver sheet 42 successively moved through the modules 31, 32, 33, 34, 35, 36. Receiver sheet 42 is transported from supply unit 40, which can include active feeding subsystems as known in the art, into printer 100. In various embodiments, the visible image can be transferred directly from an imaging roller to receiver sheet 42, or from an imaging roller to one or more transfer roller(s) or web(s) in sequence in transfer subsystem 50, and thence to receiver sheet 42. Receiver sheet 42 is, for example, a selected section of a web of, or a cut sheet of, planar media such as paper or transparency film.

Each printing module 31, 32, 33, 34, 35, 36 includes various components. For clarity, these are only shown in printing module 32. Around photoreceptor 25 are arranged, ordered by the direction of rotation of photoreceptor 25, charger 21, exposure subsystem 22, and development station 23.

In the EP process, an electrostatic latent image is formed on photoreceptor 25 by uniformly charging photoreceptor 25 and then discharging selected areas of the uniform charge to yield an electrostatic charge pattern corresponding to the desired image (a "latent image"). Charger 21 produces a uniform electrostatic charge on photoreceptor 25 or its surface. Charger 21 can be a constant-current wire charger or a constant-voltage grid charger. Exposure subsystem 22 selectively image-wise discharges photoreceptor 25 to produce a latent image. Exposure subsystem 22 can include a laser and raster optical scanner (ROS), one or more LEDs, or a linear LED array.

After the latent image is formed, charged toner particles are brought into the vicinity of photoreceptor 25 by development station 23 and are attracted to the latent image to develop the latent image into a visible image. Note that the visible image may not be visible to the naked eye depending on the composition of the toner particles (e.g. clear toner). Development station 23 can also be referred to as a development station. Toner can be applied to either the charged or discharged parts of the latent image.

After the latent image is developed into a visible image on photoreceptor 25, a suitable receiver sheet 42 is brought into juxtaposition with the visible image. In transfer subsystem 50, a suitable electric field is applied to transfer the toner particles of the visible image to receiver sheet 42 to form the desired print image 38 on the receiver sheet, as shown on receiver sheet 42A. The imaging process is typically repeated many times with reusable photoreceptors 25. A cleaning system can also be arranged along photoreceptor 25 between transfer subsystem 50 and charger 21 to prepare the photoreceptor for each successive image.

Receiver sheet 42A is then removed from its operative association with photoreceptor 25 and subjected to heat or pressure to permanently fix ("fuse") print image 38 to receiver sheet 42A. Plural print images, e.g. of separations of different colors, are overlaid on one receiver sheet before fusing to form a multi-color print image 38 on receiver sheet 42A.

Each receiver sheet 42, during a single pass through the six printing modules 31, 32, 33, 34, 35, 36, can have transferred in registration thereto up to six single-color toner images to form a pentachrome image. As used herein, the term "hexachrome" implies that in a print image, combinations of various of the six colors are combined to form other colors on receiver sheet 42 at various locations on receiver sheet 42. That is, each of the six colors of toner can be combined with toner of one or more of the other colors at a particular location on receiver sheet 42 to form a color different than the colors of the toners combined at that location. In an embodiment, printing module 31 forms black (K) print images, 32 forms yellow (Y) print images, 33 forms magenta (M) print images, 34 forms cyan (C) print images, 35 forms light-black (Lk) images, and 36 forms clear images. Another example of a hexachrome system is CMYK plus a light cyan and light magenta.

In various embodiments, printing module 36 forms print image 38 using a clear toner or tinted toner. Tinted toners absorb less light than they transmit, but do contain pigments or dyes that move the hue of light passing through them towards the hue of the tint. For example, a blue-tinted toner coated on white paper will cause the white paper to appear light blue when viewed under white light, and will cause yellows printed under the blue-tinted toner to appear slightly greenish under white light.

Receiver sheet 42A is shown after passing through printing module 36. Print image 38 on receiver sheet 42A includes unfused toner particles.

Subsequent to transfer of the respective print images 38, overlaid in registration, one from each of the respective printing modules 31, 32, 33, 34, 35, 36, receiver sheet 42A is advanced to a fuser 60, i.e. a fusing or fixing assembly, to fuse print image 38 to receiver sheet 42A. Transport web 81 transports the print-image-carrying receiver sheets 42A to fuser 60, which fixes the toner particles to the respective receiver sheets 42A by the application of heat and pressure. The receiver sheets 42A are serially de-tacked from transport web 81 to permit them to feed cleanly into fuser 60. Transport web 81 is then reconditioned for reuse at cleaning station 86 by cleaning and neutralizing the charges on the opposed surfaces of the transport web 81. A mechanical cleaning station (not shown) for scraping or vacuuming toner off transport web 81 can also be used independently or with cleaning station 86. The mechanical cleaning station can be disposed along transport web 81 before or after cleaning station 86 in the direction of rotation of transport web 81.

Fuser 60 includes a heated fusing roller 62 and an opposing pressure roller 64 that form a fusing nip 66 therebetween. In an embodiment, fuser 60 also includes a release fluid application substation 68 that applies release fluid, e.g. silicone oil, to fusing roller 62. Alternatively, wax-containing toner can be used without applying release fluid to fusing roller 62. Other embodiments of fusers 60, both contact and non-contact, can be employed. For example, solvent fixing uses solvents to soften the toner particles so they bond with the receiver sheet 42A. Photoflash fusing uses short bursts of high-frequency electromagnetic radiation (e.g. ultraviolet light) to melt the toner. Radiant fixing uses lower-frequency electromagnetic radiation (e.g. infrared light) to more slowly melt the toner. Microwave fixing uses electromagnetic radiation in the microwave range to heat the receiver sheets 42A (primarily), thereby causing the toner particles to melt by heat conduction, so that the toner is fixed to the receiver sheet 42A.

The receiver sheets (e.g., receiver sheet 42B) carrying the fused image (e.g., fused image 39) are transported in a series from the fuser 60 along a path either to a remote output tray 69, or back to printing modules 31, 32, 33, 34, 35, 36 to create an image on the backside of the receiver sheet (e.g., receiver sheet 42B), i.e. to form a duplex print. Receiver sheets (e.g., receiver sheet 42B) can also be transported to any suitable output accessory. For example, an auxiliary fuser or glossing assembly can provide a clear-toner overcoat, or a laminator can apply a protective sheet overcoat to one or both sides of the receiver sheet (e.g., receiver sheet 42B). Printer 100 can also include multiple fusers 60 to support applications such as overprinting, as known in the art.

In various embodiments, between fuser 60 and output tray 69, receiver sheet 42B passes through finisher 70. Finisher 70 performs various media-handling operations, such as folding, stapling, saddle-stitching, collating, and binding.

Printer 100 includes main printer apparatus logic and control unit (LCU) 99, which receives input signals from the various sensors associated with printer 100 and sends control signals to the components of printer 100. LCU 99 can include a microprocessor incorporating suitable look-up tables and control software executable by the LCU 99. It can also include a field-programmable gate array (FPGA), programmable logic device (PLD), microcontroller, or other digital control system. LCU 99 can include memory for storing control software and data. Sensors associated with the fusing assembly provide appropriate signals to the LCU 99. In response to the sensors, the LCU 99 issues command and control signals that adjust the heat or pressure within fusing nip 66 and other operating parameters of fuser 60 for receiver sheets 42A. This permits printer 100 to print on receiver sheets 42A of various thicknesses and surface finishes, such as glossy or matte.

Image data for writing by printer 100 can be processed by a raster image processor (RIP; not shown), which can include a color separation screen generator or generators. The output of the RIP can be stored in frame or line buffers for transmission of the color separation print data to each of respective LED writers, e.g. for black (K), yellow (Y), magenta (M), cyan (C), and red (R), respectively. The RIP or color separation screen generator can be a part of printer 100 or remote therefrom. Image data processed by the RIP can be obtained from a color document scanner or a digital camera or produced by a computer or from a memory or network which typically includes image data representing a continuous image that needs to be reprocessed into halftone image data in order to be adequately represented by the printer. The RIP can perform image processing processes, e.g. color correction, in order to obtain the desired color print. Color image data is separated into the respective colors and converted by the RIP to halftone dot image data in the respective color using matrices, which comprise desired screen angles (measured counterclockwise from rightward, the +X direction) and screen rulings. The RIP can be a suitably-programmed computer or logic device and is adapted to employ stored or computed matrices and templates for processing separated color image data into rendered image data in the form of halftone information suitable for printing. These matrices can include a screen pattern memory (SPM).

Various parameters of the components of a printing module (e.g., printing module 31) can be selected to control the operation of printer 100. In an embodiment, charger 21 is a corona charger including a grid (not shown) between one or more corona wire(s) (not shown) and photoreceptor 25. Voltage source 21*a* applies a voltage to raise the corona wire(s) to a high enough voltage to ionize the air to create electrostatic charge. Voltage source 21*a* also applies a voltage to the grid to control charging of photoreceptor 25. Some of the charge from the corona wires is deposited upon the photoreceptor, with the grid acting as a control gate. In an embodiment, a voltage bias is applied to development station 23 by voltage source 23*a* to control the electric field, and thus the rate of toner transfer, from development station 23 to photoreceptor 25. In an embodiment, a voltage is applied to a conductive base layer of photoreceptor 25 by voltage source 25*a* before development, that is, before toner is applied to photoreceptor 25 by development station 23. The applied voltage can be zero; the base layer can be grounded. This also provides control over the rate of toner deposition during development. In an embodiment, the exposure applied by exposure subsystem 22 to photoreceptor 25 is controlled by LCU 99 to produce a latent image corresponding to the desired print image. All of these parameters can be changed, as described below.

Further details regarding printer 100 are provided in U.S. Pat. No. 6,608,641, issued on Aug. 19, 2003, to Peter S. Alexandrovich et al., and in U.S. Publication No. 20060133870, published on Jun. 22, 2006, by Yee S. Ng et al., the disclosures of which are incorporated herein by reference.

Figure 2:
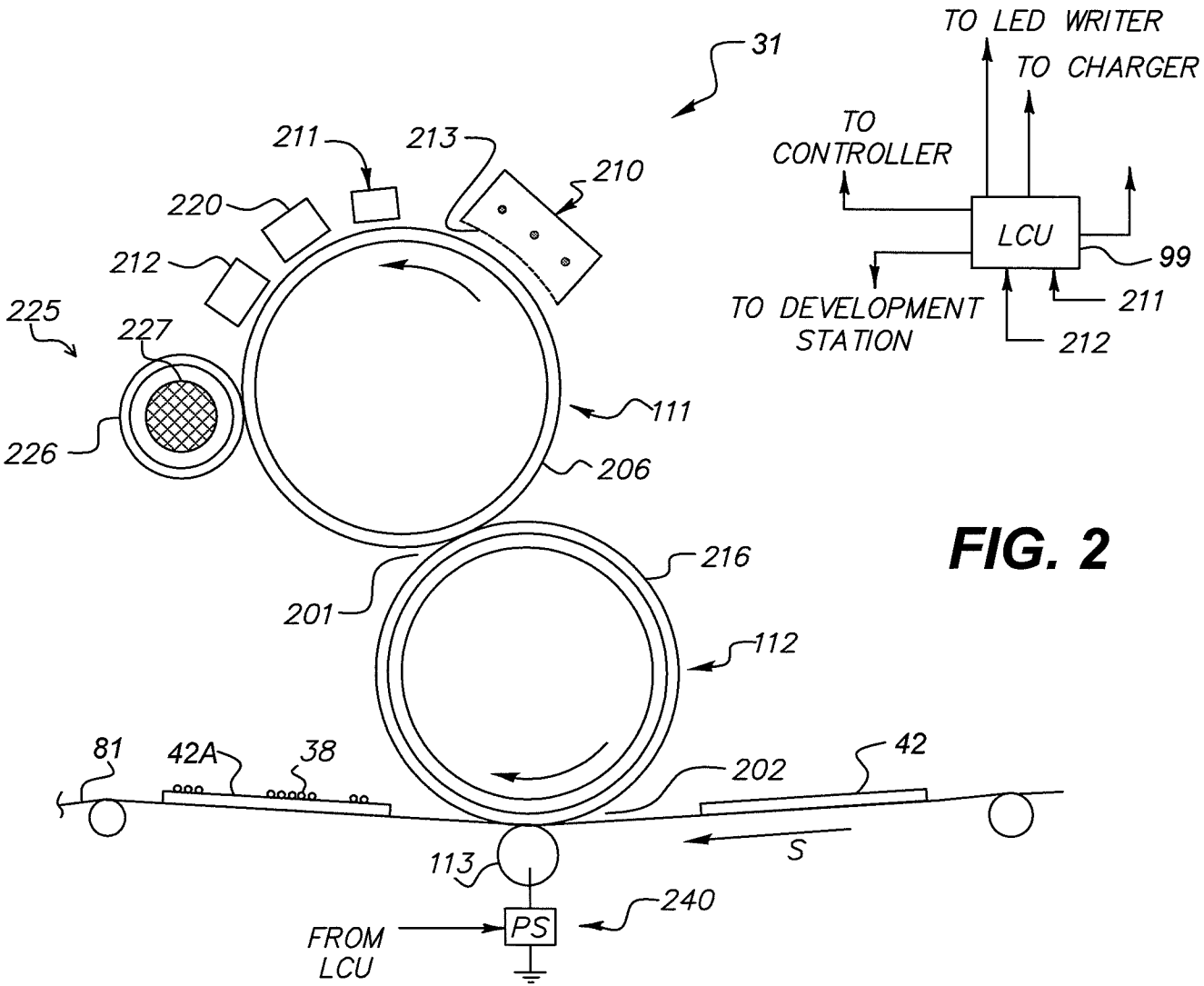
FIG. 2 shows more details of a printing module.

FIG. 2 shows more details of printing module 31, which is representative of printing modules 32, 33, 34, 35, and 36 (FIG. 1). Primary charging subsystem 210 uniformly electrostatically charges photoreceptor 206 of imaging component 111, shown in the form of an imaging cylinder. Charging subsystem 210 includes a grid 213 having a selected voltage. Meter 211 measures the uniform electrostatic charge provided by charging subsystem 210, and meter 212 measures the post-exposure surface potential within a patch area of a latent image formed from time to time in a non-image area on photoreceptor 206. LCU 99 sends control signals to the charging subsystem 210, the exposure subsystem 220 (e.g., laser or LED writers), and the respective development station 225 of each printing module 31, 32, 33, 34, 35 (FIG. 1)

Imaging component 111 includes photoreceptor 206. Photoreceptor 206 includes a photoconductive layer formed on an electrically conductive substrate. An exposure subsystem 220 is provided for image-wise modulating the uniform electrostatic charge on photoreceptor 206 by exposing photoreceptor 206 to electromagnetic radiation to form a latent electrostatic image.

Development station 225 includes toning shell 226 for applying toner of a selected color to the latent image on photoreceptor 206 to produce a visible image on photoreceptor 206. Development station 225 is electrically biased by a suitable respective voltage to develop the respective latent image. Developer is provided to toning shell 226 by a supply system (not shown). Toner is transferred by electrostatic forces from development station 225 to photoreceptor 206.

In an embodiment, development station 225 employs a two-component developer that includes toner particles and magnetic carrier particles. Development station 225 includes a magnetic core 227 to cause the magnetic carrier particles near toning shell 226 to form a "magnetic brush," as known in the electrophotographic art. Further details of magnetic core 227 can be found in U.S. Pat. No. 7,120,379 to Eck et al., issued Oct. 10, 2006, and in U.S. Publication No. 20020168200 to Stelter et al., published Nov. 14, 2002, the disclosures of which are incorporated herein by reference.

Transfer subsystem 50 (FIG. 1) includes transfer backup component 113 and intermediate transfer component 112 for transferring the respective print image 38 from photoreceptor 206 of imaging component 111 through a first transfer nip 201 to surface 216 of intermediate transfer component 112, and thence to a receiver sheet (e.g., 42) which receives the respective toned print images 38 from each printing module 31, 32, 33, 34, 35, 36, in superposition to form a composite image thereon. Print image 38 is e.g., a separation of one color, such as cyan. Receiver sheet 42 is transported by transport web 81. Transfer to receiver sheet 42 is effected by an electrical field provided to transfer backup component 113 by power source 240, which is controlled by LCU 99. Receivers 42 can be any objects or surfaces onto which toner can be transferred from imaging component 111 by application of the electric field. In this example, receiver sheet 42 is shown prior to entry into second transfer nip 202, and receiver sheet 42A is shown subsequent to transfer of the print image 38 onto receiver sheet 42A.

Figure 4:
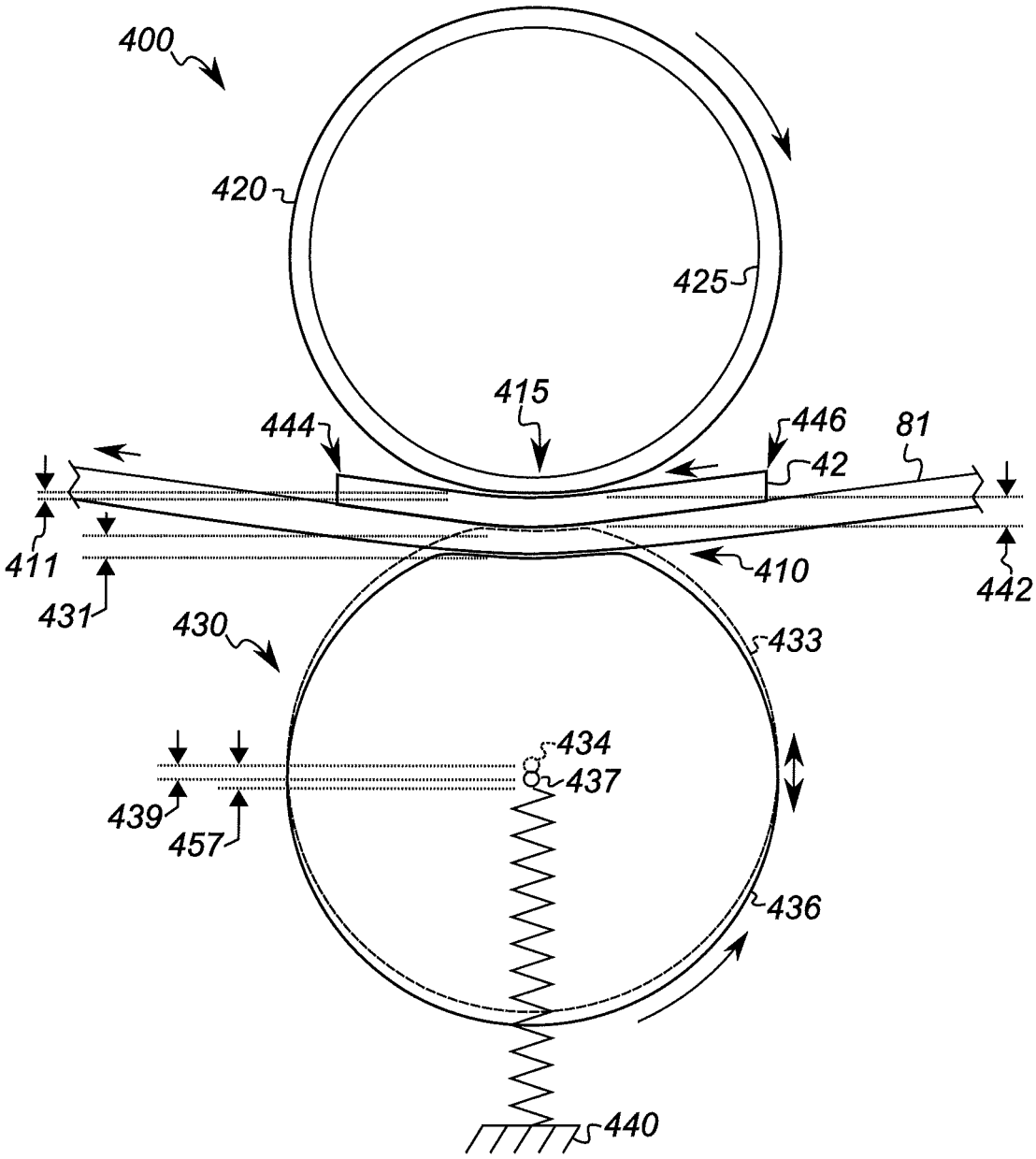
FIG. 4 shows a transfer station and related components in an electrophotographic printer.

FIG. 4 shows transfer station 400 and related components in an electrophotographic (EP) printer adapted to transfer a toner image to receiver sheet 42 carried on rotatable transport web 81. Rotatable transport web 81 has a Young's modulus E of at least 1 GPa on at least one layer, or on the whole belt, and is maintained under tension. Tension can be maintained by tensioning members (not shown). For example, the drums or rollers around which transport web 81 is wrapped in FIG. 1 can be pressed apart by springs to maintain transport web 81 under tension. Alternatively, a spring-loaded or motor-driven tensioning roller or ski pressing against transport web 81 can be used to take up slack in transport web 81 and maintain it under tension. Transport web 81 can include a compliant layer (not shown) coated over or attached to the layer(s) with a modulus of at least 1 GPa.

FIG. 4 shows transfer station 400 with receiver sheet 42 engaged in transfer nip 410. Receiver sheet 42 has thickness 442. Transport web 81 can be between 60 μm and 150 μm thick. Thicker webs can also be used. Receiver sheet 42 can be between 50 μm and 500 μm thick, or up to 2500 μm thick, or thicker.

Figure 3A:
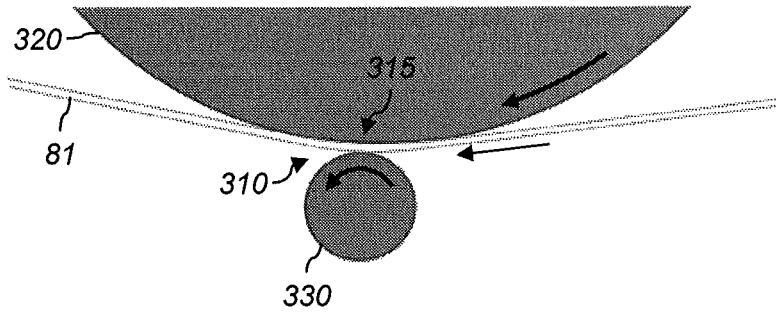
FIG. 3A PRIOR ART
FIGS. 3A-3B show the entrance of a receiver sheet on a transport web into a transfer nip according to prior schemes.
Figure 3B:
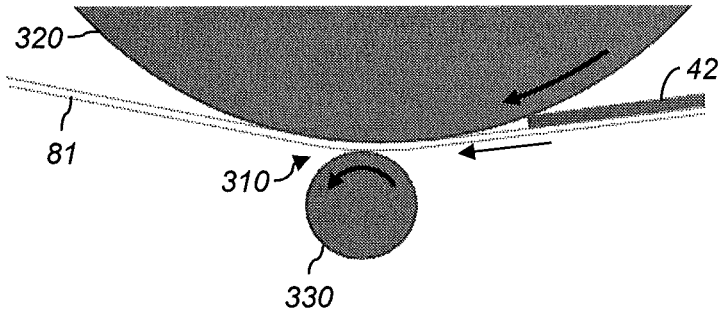
FIG. 3B PRIOR ART
Figure 3C:
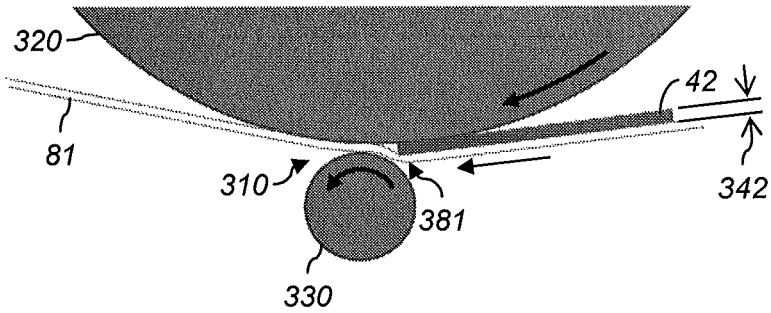
FIGS. 3C-3D show effects of the entrance of receiver 42 on transport web 81 into transfer nip 310.
Figure 3D:
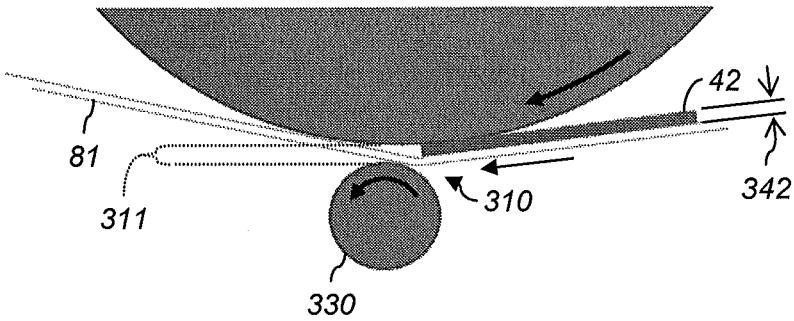

Transfer station 400 includes rotatable image-bearing member 420 around which transport web 81 is at least partially wrapped. Transport web 81 can be entrained around image-bearing member 420 or not. In transfer region 415, toner is transferred from image-bearing member 420 to receiver sheet 42. Transfer region 415 can be the same size as, larger than, or smaller than transfer nip 410. Examples of transfer region 415 and transfer nip 410 are as discussed above with respect to transfer region 315 and transfer nip 310 shown in FIG. 3A.

In various embodiments, image-bearing member 420 has a compliant coating 425. By "has a compliant coating" it is meant that either image-bearing member 420 is overlaid with a compliant coating 425, or that image-bearing member 420 is substantially or entirely compliant (e.g., is made of rubber). As shown, compliant covering 425 is deformed while receiver sheet 42 is in transfer region 415, e.g., while receiver sheet 42 is in the nip formed by image-bearing member 420 and nip-forming member 430 (discussed below). Nip-forming member 430 can be transfer backup component 113 (FIG. 2). Displacement 411 shows the deformation of compliant coating 425 from its undeformed state.

Rotatable nip-forming member 430 is disposed adjacent to transport web 81 on the opposite side thereof from image-bearing member 420 and is compressible, either by including a compressible layer (not shown) on its surface or by being composed of a compressible material or a compressible material arranged around an axis or other support member (not shown). In the example shown, nip-forming member 430 has a similar size to image-bearing member 420; in other embodiments the two can be the same or different sizes, and either can be larger. Nip-forming member 430 is at least compressible in part of transfer region 415, and can be compressible around its entire surface, e.g., by being coated or layered with a compressible material. Nip-forming member 430 can include a compressible material (e.g., a foam), and can optionally include a flexible surface (e.g., metal foil) over the foam. Any compressible material that experiences elastic deformation in transfer nip 410 can be used. Nip-forming member 430 can have a hard core for mounting. In various embodiments, the compressible portion of nip-forming member 430 in transfer region 415 has a Poisson ratio of at most 0.4.

Nip-forming member 430 is relatively less stiff than image-bearing member 420. Relative stiffness is a function of the respective geometries and respective material compositions of nip-forming member 430 and image-bearing member 420, and the properties of the materials in the compositions, including their Poisson ratios and Young's moduli. Since nip-forming member 430 is relatively less stiff than image-bearing member 420, as shown, image-bearing member 420 and transport web 81 indent nip-forming member 430. That is, a concavity is formed in the surface of nip-forming member 430 by image-bearing member 420.

In an example, image-bearing member 420 is a rigid drum coated with a 10 mm-thick compliant coating 425 of polyurethane having a Young's modulus of less than 5 MPa and a Poisson ratio of at least 0.48. Image-bearing member 420 can include a release layer of less than 20 μm in thickness with a Young's modulus greater than 100 MPa. Nip-forming member 430 is a foam wrapped around a rigid core. The foam has a Poisson ratio of at most 0.4 and a Young's modulus less than 5 MPa. The outer diameter of image-bearing member 420 is 174 mm. The outer diameter of nip-forming member 430 is 44 mm. The drum and polyurethane of image-bearing member 420 are together relatively stiffer than foam-covered nip-forming member 430. In various embodiments, the foam-covered nip-forming member 430 has a Young's modulus of <1 MPa, or about 0.6 MPa.

Two positions of nip-forming member 430 are shown. The dashed lines, position 433, show nip-forming member 430 in its position before receiver sheet 42 enters transfer nip 410. The solid lines, position 436, show nip-forming member 430 in its position when receiver sheet 42 is in transfer nip 410. Axis 434 is the axis of rotation, or axle, of nip-forming member 430 in position 433; axis 437 is likewise for position 436.

Mount 440 is arranged to cause nip-forming member 430 to press transport web 81 towards image-bearing member 420. Mount 440 also permits axis of rotation 434, 437 of nip-forming member 430 to move closer to or farther from transport web 81. In the example shown, mount 440 includes a spring between the axis of rotation of nip-forming member 430 (e.g., axis 437) and a fixed anchor. In various embodiments, mount 440 causes nip-forming member 430 to press transport web 81 towards image-bearing member 420 with a force of at least 50N.

When leading edge 444 of moving receiver sheet 42 on transport web 81 engages with image-bearing member 420, nip-forming member 430 compresses. The compression is shown by displacement 431. As a result of this compression, while leading edge 444 of receiver sheet 42 passes through transfer region 415, the axis 434 of rotation of nip-forming member 430 translates (to axis 437) by an amount (displacement 439) less than thickness 442 of receiver sheet 42 minus the compression (displacement 411) of compliant coating 425 of image-bearing member 420. That is, the displacement of nip-forming member 430 is less than would be expected from thickness 442 of receiver sheet 42 and the compression of image-bearing member 420 because nip-forming member 430 is compressed instead of being displaced. Displacement 457 shows thickness 442 minus displacement 411, for comparison; displacement 439 is less than displacement 457.

In another example, as trailing edge 446 of moving receiver sheet 42 on transport web 81 disengages from image-bearing member 420, nip-forming member 430 decompresses. Axis 437 of rotation of nip-forming member 430 translates back to axis 434. This translation is by an amount less than thickness 442 of receiver sheet 42 minus the compression (displacement 411) produced in compliant coating 425 of image-bearing member 420 while receiver sheet 42 is engaged with image-bearing member 420.

Depending on the geometry of transfer region 415 (e.g., the sizes and relative positions of image-bearing member 420, transport web 81 and nip-forming member 430), in various embodiments, receiver sheet 42 on transport web 81 can engage image-bearing member 420 before, after, or at the same time as it engages nip-forming member 430. In various embodiments, transport web 81 can press into nip-forming member 430 only when receiver sheet 42 is engaged in transfer region 415, or when receiver sheet 42 is approaching transfer region 415 and has engaged image-bearing member 420 but not nip-forming member 430. All of these embodiments, and other embodiments obvious to those of ordinary skill in the art, are intended to be included in the above descriptions of "when moving receiver sheet 42 on transport web 81 engages with image-bearing member 420."

In other embodiments, image-bearing member 420 is rigid. In an example, image-bearing member 420 is a photoreceptor, and the printer is a direct-transfer printer. In such a case, displacement 411 is substantially zero.

Unlike printers described above that transfer onto an intermediate belt and then onto a receiver, various embodiments described herein reduce shock-wave formation or severity even under high nip loads. Some prior printers use low nip loads, e.g., ~13N (~3 lbf), when transferring from the photoreceptor to an intermediate web using a foam backup roller opposite the web from the photoreceptor. These low nip loads cannot be used in friction-driven systems, i.e., systems in which image-bearing member 420 is rotated by the frictional forces between image-bearing member 420 and driven transport web 81. In various embodiments herein, by contrast, mount 440 causes nip-forming member 430 to press transport web 81 towards image-bearing member 420 with a force of at least 50N, or at least 140N, or of 150N-180N. These embodiments reduce shock waves in friction-driven systems or in non-friction-driven systems. Moreover, since embodiments described herein transfer to receiver sheet 42, nip forces of at least 50N enable the compliant image-bearing member 420 to better conform to the irregularities of a rough receiver sheet 42 while it passes through transfer nip 410. Higher forces are preferably used with rougher receiver sheets 42. This permits transferring onto rougher-surfaced receiver sheets 42 than prior schemes.

Moreover, prior systems that transfer a multicomponent image from an intermediate web to a receiver use a foam or other compliant backup roller on the receiver side, i.e., that presses the receiver against the intermediate web. In contrast, various embodiments herein use compressible nip-forming member 430 on the non-receiver side, i.e., to press transport web 81 against receiver sheet 42, and both towards image-bearing member 420. As described above, this permits using rougher-surfaced receivers. Even though transport web 81 has a very stiff layer (modulus at least 1 GPa) and is held under tension, compressible nip-forming member 430 is still effective at reducing shock waves when on the opposite side of transport web 81 from receiver sheet 42.

Figure 5:
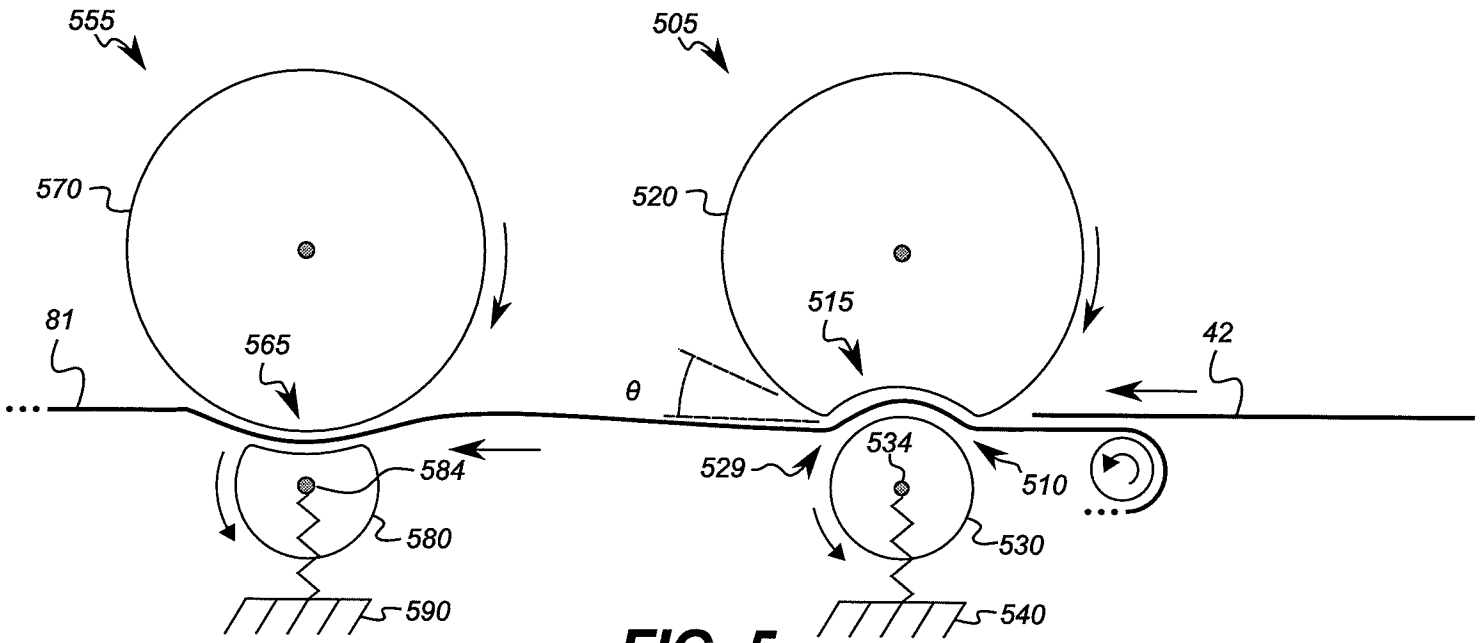
FIGS. 5 and 6 show portions of an electrophotographic printer.

FIG. 5 shows portions of an electrophotographic printer. Transport web 81 and receiver sheet 42 are as described above with reference to FIG. 4. The path of web 81 and corresponding deformations in the adjacent rollers are exaggerated for clarity.

First transfer station 505 adjacent to transport web 81 includes first rotatable image-bearing member 520 around which transport web 81 is at least partially wrapped so that a first transfer region 515 is defined in which toner is transferred from first image-bearing member 520 to receiver sheet 42. Image-bearing member 520 has a compliant coating, as discussed above.

First rotatable nip-forming member 530 is relatively stiffer than first rotatable image-bearing member 520. In an example, first rotatable nip-forming member 530 has a Poisson ratio of at least 0.45, and preferably of at least 0.48 or more than 0.48. That is, nip-forming member 530 is substantially incompressible.

First nip-forming member 530 is disposed adjacent to transport web 81 on the opposite side thereof from first image-bearing member 520. Since nip-forming member 530 is relatively stiffer than image-bearing member 520, as shown, nip-forming member 530 and transport web 81 indent image-bearing member 520. That is, a concavity is formed in the surface of first rotatable image-bearing member 520 by the first rotatable nip-forming member 530. (Concavity is further discussed above.) This provides a high angle θ at release point 529 between the direction of travel of transport web 81 and the direction of travel of a point on the surface of image-bearing member 520. This high angle provides favorable release geometry and reduces the probability of receiver sheet 42 sticking to image-bearing member 520 instead of transport web 81 as receiver sheet 42 leaves transfer nip 510.

This is useful in embodiments that, for example, use webs wrapped around rollers, such as the configuration shown, in which some of receiver sheet 42 overhangs transport web 81 while receiver sheet 42 passes through transfer nip 510. Receiver sheet 42 is normally held to transport web 81 by electrostatic tack-down forces. When not all of receiver sheet 42 is in contact with transport web 81, the tack-down forces are less than when all of receiver sheet 42 is in contact with transport web 81. More favorable release geometry reduces the tack-down force required to keep receiver sheet 42 on transport web 81.

Mount 540 is arranged to cause first nip-forming member 530 to press transport web 81 towards first image-bearing member 520, e.g., as discussed above with reference to mount 440 (FIG. 4). Mount 540 also permits axis of rotation 534 of first nip-forming member 530 to move closer to or farther from transport web 81, or the nominal position thereof (when no receiver sheet 42 is engaged with first image-bearing member 520). In various embodiments, mount 540 causes first nip-forming member 530 to press transport web 81 towards first image-bearing member 520 with a force of at least 50N. Mount 540 can include a spring and a fixed base.

Second transfer station 555 is adjacent to transport web 81 downstream of first transfer station 505 (i.e., beyond first transfer station 505 in the direction of travel of receiver sheet 42 on transport web 81). Second transfer station 555 includes second rotatable image-bearing member 570 around which transport web 81 is at least partially wrapped, whether actually entrained or not. In second transfer region 565, toner is transferred from second image-bearing member 570 to receiver sheet 42. Image-bearing member 570 has a compliant coating.

Second compressible, rotatable nip-forming member 580 in transfer station 555 is relatively less stiff than second rotatable image-bearing member 570. As discussed above, nip-forming member 580 can be formed of a compliant material or include a compliant layer on its surface or an axis or other support member. In an example, second compressible, rotatable nip-forming member 580 has a Poisson ratio of at most 0.4, e.g., between 0.25 and 0.33, and is disposed adjacent to the transport web on the opposite side thereof from second image-bearing member 570. The compliant layer (or compliant material, if, e.g., a foam roller is used) has a Young's modulus of at most 5 MPa. For example, open- or closed-cell foams can be used, but steel cannot even though its Poisson ratio is <0.4. Since second nip-forming member 580 is relatively less stiff than second image-bearing member 570, as shown, second image-bearing member 570 and transport web 81 indent second nip-forming member 580. That is, a concavity is formed in the surface of second rotatable nip-forming member 580 by second rotatable image-bearing member 570. In various embodiments, second compressible, rotatable nip-forming member 580 has a Young's modulus of <1 MPa, or about 0.6 MPa.

Mount 590 is arranged to cause second nip-forming member 580 to press transport web 81 towards second image-bearing member 570, as discussed above with reference to mount 440 (FIG. 4). Mount 590 also permits axis of rotation 584 of second nip-forming member 580 to move closer to or farther from transport web 81, or the nominal position thereof (when no receiver sheet 42 is engaged with image-bearing member 570). In various embodiments, mount 590 causes second nip-forming member 580 to press transport web 81 towards second image-bearing member 570 with a force of at least 50N.

When leading edge 444 (FIG. 4) of moving receiver sheet 42 on transport web 81 engages with second image-bearing member 570 in second transfer station 555, second nip-forming member 580 compresses. As a result, while leading edge 444 of receiver sheet 42 passes through the second transfer region 565, axis of rotation 584 of second nip-forming member translates by an amount less than the thickness of receiver sheet 42 minus the compression of the compliant coating of second image-bearing member 570. This is as described above with reference to FIG. 4. This compression reduces the power in mechanical waves (shock waves) propagating along transport web 81, so reduces artifacts. The release angle is not as large as angle θ in first transfer station 505, but the whole of receiver sheet 42 is tacked to transport web 81. As a result, a less-favorable release geometry still provides effective release. As discussed above, "when" leading edge 444 of receiver sheet 42 engages with second image-bearing member 570 includes any order of engagement of receiver sheet 42 with the various components of second transfer station 555.

Figure 6:
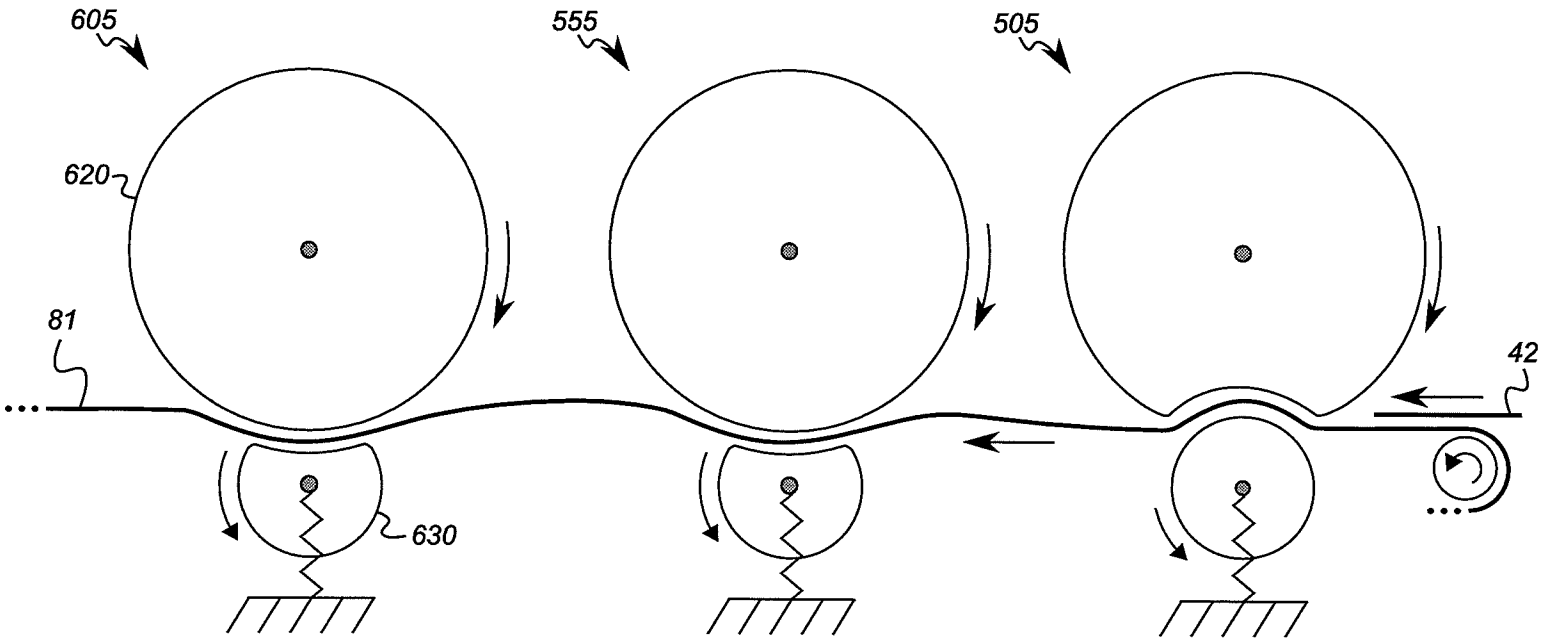

FIG. 6 shows portions of an EP printer. The path of web 81 and corresponding deformations in the adjacent rollers are exaggerated for clarity. Transport web 81, receiver sheet 42, transfer station 505, and transfer station 555 are as shown in FIG. 5. Third transfer station 605 is downstream of second transfer station 555. Third transfer station includes components corresponding to those described for transfer station 555 in FIG. 5. In an example, transfer station 605 includes third rotatable image-bearing member 620 and third rotatable nip-forming member 630 disposed adjacent to transport web 81. Third rotatable nip-forming member 630 is relatively less stiff than third rotatable image-bearing member 620, so third rotatable image-bearing member 620 indents third rotatable nip-forming member 630.

As described above with reference to second transfer station 555, when leading edge 444 (FIG. 4) of moving receiver sheet 42 on transport web 81 engages with third image-bearing member 620 in third transfer station 605, third nip-forming member 630 compresses. As a result, while leading edge 444 of receiver sheet 42 passes through the third transfer region, the axis of rotation of third nip-forming member 630 translates by an amount less than the thickness of receiver sheet 42 minus the compression of the compliant coating of third image-bearing member 620. This is as described above with reference to FIG. 4. This reduces artifacts and permits effective release. Artifacts are reduced both as leading edge 444 of receiver sheet 42 enters the third transfer region (and other transfer regions with nip-forming members having a Poisson ratio of at most 0.4) and as trailing edge 446 (FIG. 4) leaves the third transfer region. As discussed above, "when" leading edge 444 of receiver sheet 42 engages with third image-bearing member 620 includes any order of engagement of receiver sheet 42 with the various components of third transfer station 605.

Moreover, as receiver sheet 42 travels along transport web 81 and passes through successive transfer stations 505, 555, 605, the electrostatic attraction of receiver sheet 42 to transport web 81 increases. Referring back to FIG. 4, as receiver sheet 42 exits transfer nip 410, air breakdown occurs between image-bearing member 420 and receiver sheet 42. This "post-nip ionization" showers charge on receiver sheet 42. Also, at the point at which transport web 81 separates from nip-forming member 430, post-nip ionization showers charge on transport web 81. This charge is of the opposite polarity to the charge showered on receiver sheet 42. Consequently, each pass through a transfer station 400 adds oppositely-signed charges to receiver sheet 42 and transport web 81, increasing the electrostatic attraction between them. This increase in attraction holds receiver sheet 42 more strongly to transport web 81 after each transfer station 505, 555, 605.

This progressive increase in electrostatic attractive forces can provide additional latitude for adjustments in transfer station geometries as receiver sheet 42 moves through the printer. In one example, nip-forming members 430 are successively farther downstream in successive transfer stations 400. Moving nip-forming member 430 downstream in a first transfer station 400 improves the pre-nip wrap of the following transfer station, but makes it more difficult to release receiver sheet 42 from transport web 81 in the first transfer station 400. However, the increased electrostatic attractive forces can provide effective release of receiver sheet 42 from image-bearing member 420 in the first transfer station 400, permitting nip-forming member 430 to be located downstream.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. The word "or" is used in this disclosure in a non-exclusive sense, unless otherwise explicitly noted.

The invention has been described in detail with particular reference to certain preferred embodiments thereof, but it will be understood that variations, combinations, and modifications can be effected by a person of ordinary skill in the art within the spirit and scope of the invention.

PARTS LIST

21 charger
21*a* voltage source

22 exposure subsystem
23 development station
23*a* voltage source
25 photoreceptor
25*a* voltage source
31, 32, 33, 34, 35, 36 printing module
38 print image
39 fused image
40 supply unit
42, 42A, 42B receiver sheet
50 transfer subsystem
60 fuser
62 fusing roller
64 pressure roller
66 fusing nip
68 release fluid application substation
69 output tray
70 finisher
81 transport web
86 cleaning station
99 logic and control unit (LCU)
100 printer
111 imaging component
112 intermediate transfer component
113 transfer backup component
201 first transfer nip
202 second transfer nip
206 photoreceptor
210 charging subsystem
211 meter
212 meter
213 grid
216 surface
220 exposure subsystem
225 development station
226 toning shell
227 magnetic core
240 power source
310 transfer nip
311 displacement
315 transfer region
320 image-bearing member
330 nip-forming member
342 thickness
381 point
400 transfer station
410 transfer nip
411 displacement
415 transfer region
420 image-bearing member
425 compliant coating
430 nip-forming member
431 displacement
433 position
434 axis
436 position
437 axis
439 displacement
440 mount
442 thickness
444 leading edge
446 trailing edge
457 displacement
505 transfer station
510 transfer nip
515 transfer region
520 image-bearing member
529 release point
530 nip-forming member
534 axis of rotation
540 mount
555 transfer station
565 transfer region
570 image-bearing member
580 nip-forming member
584 axis of rotation
590 mount
605 transfer station
620 image-bearing member
630 nip-forming member
θ angle

The invention claimed is:

1. An electrophotographic (EP) printer adapted to transfer a toner image to a receiver sheet carried on a rotatable transport web, the printer comprising:

a) the rotatable transport web having a Young's modulus of at least 1 GPa and maintained under tension; and b) a transfer station including:

i) a rotatable image-bearing member around which the transport web is at least partially wrapped so that a transfer region is defined in which toner is transferred from the image-bearing member to the receiver sheet, the image-bearing member having a compliant coating;

ii) a compressible, rotatable nip-forming member adjacent to the transport web on the opposite side thereof from the image-bearing member, the nip-forming member being relatively less stiff than the image-bearing member; and iii) a mount arranged to cause the nip-forming member to press the transport web towards the image-bearing member, and adapted to permit the axis of rotation of the nip-forming member to move closer to or farther from the transport web;

c) so that when a leading edge of the moving receiver sheet on the transport web engages with the image-bearing member, the nip-forming member compresses so that while the leading edge of the receiver sheet passes through the transfer region, an axis of rotation of the nip-forming member translates by an amount less than the thickness of the receiver sheet minus a compression of the compliant coating of the image-bearing member.

2. The printer according to claim 1, wherein the mount causes the nip-forming member to press the transport web towards the image-bearing member with a force of at least 50N.

3. An electrophotographic (EP) printer adapted to transfer a toner image to a receiver sheet carried on a rotatable transport web, the printer comprising:

a) the rotatable transport web having a Young's modulus of at least 1 GPa and maintained under tension; and b) a transfer station including:

i) a rotatable image-bearing member around which the transport web is at least partially wrapped so that a transfer region is defined in which toner is transferred from the image-bearing member to the receiver sheet, the image-bearing member having a compliant coating;

ii) a compressible, rotatable nip-forming member adjacent to the transport web on the opposite side thereof from the image-bearing member, the nip-forming member being relatively less stiff than the rotatable image-bearing member; and iii) a mount arranged to cause the nip-forming member to press the transport web towards the image-bearing member, and adapted to permit the axis of rotation of the nip-forming member to move closer to or farther from the transport web;

c) so that as a trailing edge of the moving receiver sheet on the transport web disengages from the image-bearing member, the nip-forming member decompresses and an axis of rotation of the nip-forming member translates by an amount less than the thickness of the receiver sheet minus a compression produced in the compliant coating of the image-bearing member while the receiver sheet is engaged with the image-bearing member.

4. The printer according to claim 3, wherein the mount causes the nip-forming member to press the transport web towards the image-bearing member with a force of at least 50N.

* * * * *